US010643786B2

(12) United States Patent
Miyazaki

(10) Patent No.: US 10,643,786 B2
(45) Date of Patent: May 5, 2020

(54) COIL COMPONENT AND METHOD FOR MANUFACTURING COIL COMPONENT

(71) Applicant: SUMIDA CORPORATION, Chuo-ku, Tokyo (JP)

(72) Inventor: Hiroyuki Miyazaki, Natori (JP)

(73) Assignee: SUMIDA CORPORATION (JP)

( * ) Notice: Subject to any disclaimer, the term of this patent is extended or adjusted under 35 U.S.C. 154(b) by 2 days.

(21) Appl. No.: 15/840,148

(22) Filed: Dec. 13, 2017

(65) Prior Publication Data

US 2018/0218831 A1 Aug. 2, 2018

(30) Foreign Application Priority Data

Jan. 27, 2017 (JP) ..... 2017-012701

(51) Int. Cl.

| | |
|---|---|
| ***H01F 27/30*** | (2006.01) |
| ***H01F 27/32*** | (2006.01) |
| ***H01F 5/02*** | (2006.01) |
| ***H01F 41/061*** | (2016.01) |
| ***H01F 41/098*** | (2016.01) |
| ***H01F 27/28*** | (2006.01) |
| *H01F 27/00* | (2006.01) |

(52) U.S. Cl.

CPC ..... *H01F 27/325* (2013.01); *H01F 5/02* (2013.01); *H01F 27/2823* (2013.01); *H01F 27/323* (2013.01); *H01F 41/061* (2016.01); *H01F 41/098* (2016.01); *H01F 27/006* (2013.01)

(58) Field of Classification Search

CPC ..... H01F 27/323; H01F 5/02

USPC ..... 336/185

See application file for complete search history.

(56) References Cited

U.S. PATENT DOCUMENTS

2004/0196128 A1 10/2004 DuVal

FOREIGN PATENT DOCUMENTS

| | | | |
|---|---|---|---|
| JP | H08-264338 | A | 10/1996 |
| JP | 2006-120767 | A | 5/2006 |
| JP | 2006-147927 | A | 6/2006 |

OTHER PUBLICATIONS

Extended European Search Report for EP Application No. 18152911.6, dated Jun. 15, 2018 (9 pages).

*Primary Examiner* — Ronald Hinson

(74) *Attorney, Agent, or Firm* — Harness, Dickey & Pierce, P.L.C.

(57) ABSTRACT

A coil component includes an edgewise coil and a bobbin around which the edgewise coil is wound. The bobbin includes a tubular bobbin body, and plural position-limiting protruding portions arranged in plural portions on the outer peripheral surface of the bobbin body and limit the position of each winding portion of the edgewise coil in the axial direction of the bobbin body. The plural position-limiting protruding portions include first and second position-limiting protruding portions, which are disposed at different positions in the axial direction of the bobbin body. The edgewise coil includes a first winding portion that is in pressure contact with the first position-limiting protruding portion toward the second position-limiting protruding portion, and a second winding portion that is in pressure contact with the second position-limiting protruding portion toward the first position-limiting protruding portion.

5 Claims, 15 Drawing Sheets

COIL COMPONENT AND METHOD FOR MANUFACTURING COIL COMPONENT

TECHNICAL FIELD

The present invention relates to coil components and methods for manufacturing a coil component.

BACKGROUND ART

Japanese Patent Application Laid-open No. 2006-120767 describes a coil component including a core and a coil wound around the outer periphery of the coil, in which plural protruding portions, each of which is arranged between winding portions of the coil to determine the position of each winding portion, are formed integrally with the outer peripheral surface of the core.

This coil component is manufactured in the following manner.

First, the core is inserted into the coil in a state where the diameter of the coil is increased by twisting it in a radially expanding direction.

Then, twisting of the coil is released to make the diameter of the coil elastically return to the original diameter. At this time, each protruding portion of the core is arranged between individual winding portions of the coil. In this manner, the coil is wound around the outer periphery of the core.

In this way, changes in positions of each of the winding portions are limited in the axial direction of the coil by the plural protruding portions.

SUMMARY OF THE INVENTION

According to the present invention, there is provided a coil component, which includes:

an edgewise coil; and a bobbin around which the edgewise coil is wound, in which the bobbin includes:

a tubular bobbin body; and a plurality of position-limiting protruding portions arranged in a plurality of portions on an outer peripheral surface of the bobbin body and limiting a position of a winding portion of the edgewise coil in an axial direction of the bobbin body, the plurality of position-limiting protruding portions include a first position-limiting protruding portion and a second position-limiting protruding portion that are disposed at positions different from each other in the axial direction of the bobbin body, the edgewise coil includes:

a first winding portion that is in pressure contact with the first position-limiting protruding portion toward the second position-limiting protruding portion; and a second winding portion that is in pressure contact with the second position-limiting protruding portion toward the first position-limiting protruding portion, and the edgewise coil is in a state of space winding in which respective winding portions from the first winding portion to the second winding portion are spaced apart from each other in the axial direction of the bobbin body.

Furthermore, according to the present invention, there is provided a method for manufacturing a coil component by winding an edgewise coil around a bobbin, the method including:

preparing a bobbin including:

a tubular bobbin body; and a plurality of position-limiting protruding portions arranged in a plurality of portions on an outer peripheral surface of the bobbin body and limiting a position of each winding portion of the edgewise coil in an axial direction of the bobbin body, the plurality of position-limiting protruding portions including a first position-limiting protruding portion and a second position-limiting protruding portion that are disposed at positions different from each other in the axial direction of the bobbin body; and winding the edgewise coil around the bobbin by screwing the bobbin and the edgewise coil with each other, in a manner such that:

the edgewise coil includes:

a first winding portion that is in pressure contact with the first position-limiting protruding portion toward the second position-limiting protruding portion; and a second winding portion that is in pressure contact with the second position-limiting protruding portion toward the first position-limiting protruding portion, and the edgewise coil is in a state of space winding in which respective winding portions from the first winding portion to the second winding portion are spaced apart from each other in the axial direction of the bobbin body.

According to the present invention, the edgewise coil includes the first winding portion that is in pressure contact with the first position-limiting protruding portion toward the second position-limiting protruding portion and the second winding portion that is in pressure contact with the second position-limiting protruding portion toward the first position-limiting protruding portion. In addition, the edgewise coil is in the state of space winding where respective winding portions from the first winding portion to the second winding portion are spaced apart from each other in the axial direction of the bobbin body. With such a structure, it is possible to stably assemble the edgewise coil to the bobbin, and stably maintain the positions of the winding portions of the coil.

DESCRIPTION OF EMBODIMENTS

Figure 1:
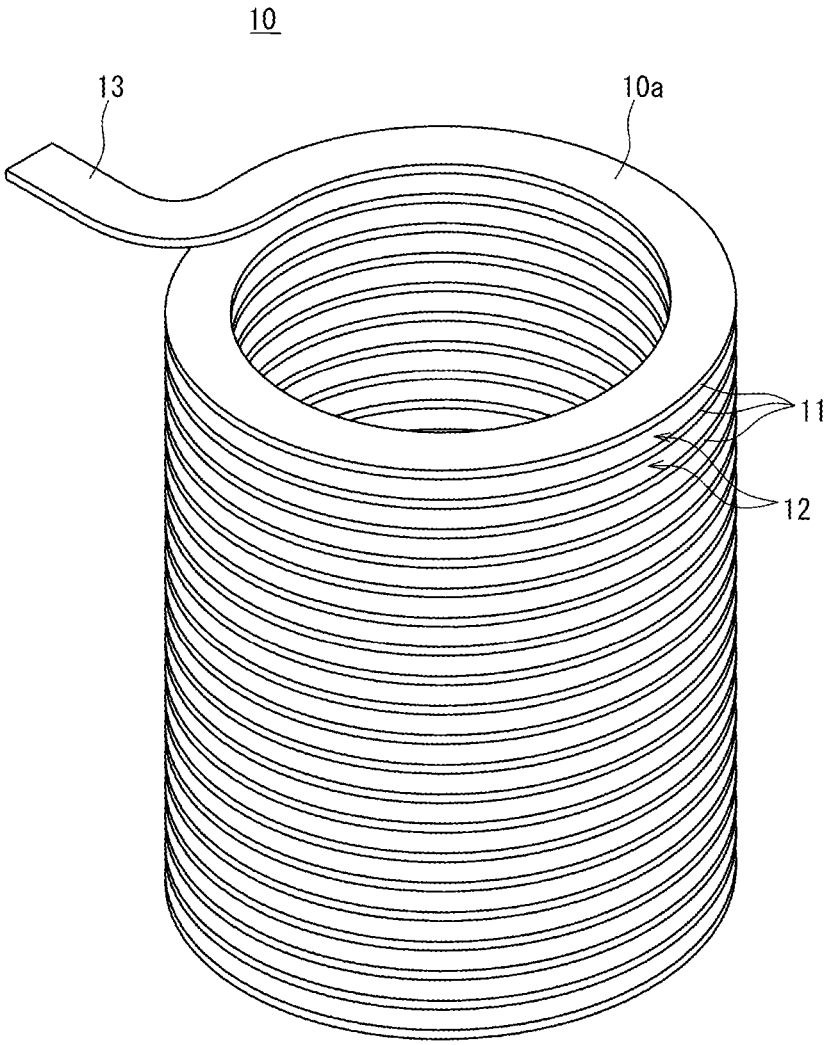
FIG. 1 is a perspective view illustrating a coil that a coil component according to the first exemplary embodiment has.

However, as a result of studies made by the present inventor, there are rooms for improvement in the technique described in Japanese Patent Application Laid-open No. 2006-120767 in terms of stability of the position of each of the winding portions in the axial direction of the coil.

The present invention has been made in view of the problem described above, and is to provide a coil component having a structure that can more stably maintain the position of each winding portion of the coil, and also provide a method for manufacturing the coil component.

The above and other objects, advantages and features of this invention will be more apparent from the following description of certain preferred embodiments taken in conjunction with the accompanying drawings.

Hereinbelow, exemplary embodiments according to the present invention will be described with reference to the drawings. Note that, in all the drawings, the same reference characters are attached to similar constituent components, and detailed explanation thereof will not be repeated as appropriate.

First Exemplary Embodiment

First, a coil component 40 according to this exemplary embodiment will be described with reference to FIGS. 1 to 10.

The coil component 40 according to this exemplary embodiment includes an edgewise coil 10 and a bobbin 20 around which the edgewise coil 10 is wound. The bobbin 20 includes a tubular bobbin body 20*a*, and a plurality of position-limiting protruding portions (for example, plural position-limiting protruding portions 21, plural position-limiting protruding portions 22, plural position-limiting protruding portions 23, and plural position-limiting protruding portions 24) that are arranged in a plurality of portions on an outer peripheral surface of the bobbin body 20*a* and limit the position of each winding portion 11 of the edgewise coil 10 in the axial direction of the bobbin body 20*a*. The plurality of position-limiting protruding portions include a first position-limiting protruding portion (for example, a position-limiting protruding portion 22*b* illustrated in FIG. 9 and so on) and a second position-limiting protruding portion (for example, a position-limiting protruding portion 22*z* illustrated in FIG. 9 and so on) that are disposed at positions different from each other in the axial direction of the bobbin body 20*a*. The edgewise coil 10 includes a first winding portion (for example, a winding portion 11*a* illustrated in FIG. 9) that is in pressure contact with the first position-limiting protruding portion toward the second position-limiting protruding portion, and a second winding portion (for example, a winding portion 11*z* illustrated in FIG. 9) that is in pressure contact with the second position-limiting protruding portion toward the first position-limiting protruding portion. The edgewise coil 10 is in a state of space winding in which respective winding portions 11 from the first winding portion to the second winding portion are spaced apart from each other in the axial direction of the bobbin body 20*a*.

Here, the space winding represents a way of winding which is also called pitch winding.

Furthermore, each of the winding portions 11 is a portion of the edgewise coil 10 that makes one round around the bobbin 20, and the edgewise coil 10 is an assembly of plural winding portions 11 arranged seamlessly in a spiral shape.

In addition, the first position-limiting protruding portion and the second position-limiting protruding portion may be arranged alongside each other in the axial direction of the bobbin body 20*a*, or may be arranged alongside each other in a direction intersecting the axial direction. Moreover, the direction of the second position-limiting protruding portion with respect to the first position-limiting protruding portion (the direction in which the first winding portion is in pressure contact with the first position-limiting protruding portion) and the direction of the first position-limiting protruding portion with respect to the second position-limiting protruding portion (the direction in which the second winding portion is in pressure contact with the second position-limiting protruding portion) may be the axial direction of the bobbin body 20*a*, or may be the direction intersecting this axial direction.

In the case of the coil component 40 according to this exemplary embodiment, the edgewise coil 10 is in a state of space winding in which respective winding portions 11 from the first winding portion to the second winding portion are spaced apart from each other in the axial direction of the bobbin body 20*a*. This configuration enables a stray capacity and a proximity effect between winding portions 11 to be reduced, and hence, it is possible to obtain the coil component 40 with high quality factor, and also possible to reduce the size of the coil component 40. Furthermore, the coil component 40 is configured so as to include the edgewise coil 10 using a rectangular wire, and hence, it is possible to reduce the skin effect. In addition, since individual winding portions 11 are space apart from each other, it is possible to achieve a favorable heat dissipation property.

Furthermore, the first winding portion of the edgewise coil 10 is in pressure contact with the first position-limiting protruding portion toward the second position-limiting protruding portion, and at the same time, the second winding portion of the edgewise coil 10 is in pressure contact with the second position-limiting protruding portion toward the first position-limiting protruding portion. With this configuration, it is possible to stably determine the positions of the first winding portion and the second winding portion with respect to the first position-limiting protruding portion and the second position-limiting protruding portion, respectively. Thus, it is possible to more stably maintain the position of each of the winding portions 11 of the edgewise coil 10.

The coil component 40 according to this exemplary embodiment can be favorably used as a resonance coil for a field coupling non-contact power supply system, can be used at high frequencies (for example, a band of MHz) and with large electric power (the order of kw or higher), and has a structure that has reduced loss. In such a resonance coil, the alternating-current resistance due to stray capacity, proximity effect and core loss causes a large loss. However, in the case of the coil component 40 according to this exemplary embodiment, the stray capacity and the proximity effect between winding portions 11 can be reduced, so that the alternating-current resistance can be suppressed. In addition, the edgewise coil 10 configured with a rectangular wire is used to increase the surface area of the edgewise coil 10, so that the skin effect can be reduced. Thus, it is possible to obtain a resonance coil having an excellent quality factor.

That is, in the case of the coil component 40 according to this exemplary embodiment, although inductance is reduce, the capacitance can be largely reduced, and hence, it is possible to obtain sufficient quality factor. Furthermore, the edgewise coil 10 having a favorable heat dissipation property can be obtained.

Below, detailed description will be given.

As illustrated in FIG. 1, the edgewise coil 10 is formed by spirally winding a metal wire 10*a*, which is a rectangular wire, and has plural winding portions 11. The winding portions 11 each have a winding diameter equivalent to each other.

The edgewise coil 10 has an outwardly extending piece 13 at both ends thereof.

The edgewise coil 10 may be configured such that, before wound around the bobbin 20, adjacent winding portions 11 may be in contact with each other (for example, the edgewise coil 10 may be tightly wound in a manner such that no space 12 exists between adjacent winding portions 11).

Figure 2:
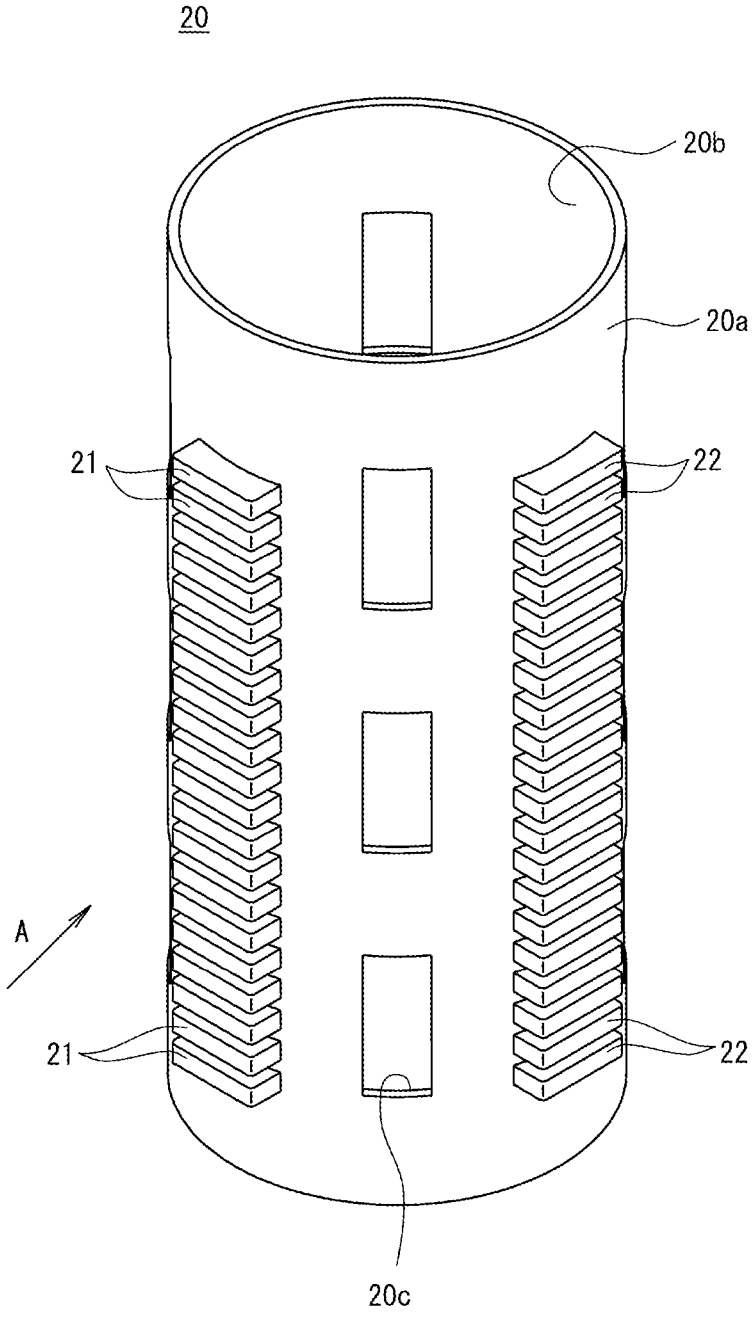
FIG. 2 is a perspective view illustrating a bobbin that the coil component according to the first exemplary embodiment has.
Figure 3:
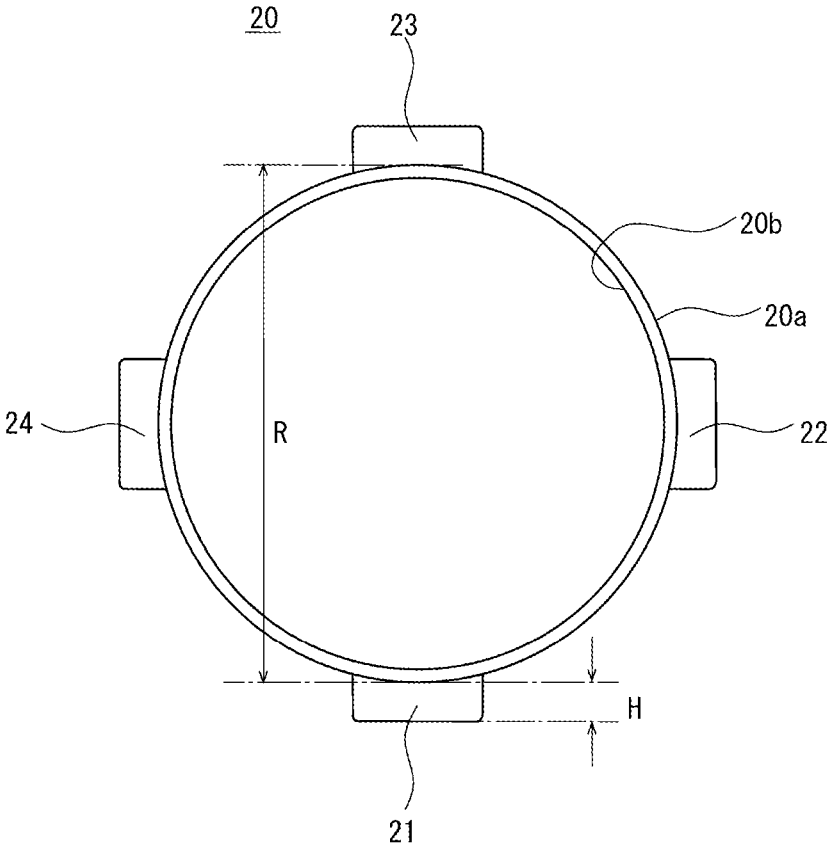
FIG. 3 is a plan view illustrating the bobbin that the coil component according to the first exemplary embodiment has.
Figure 4:
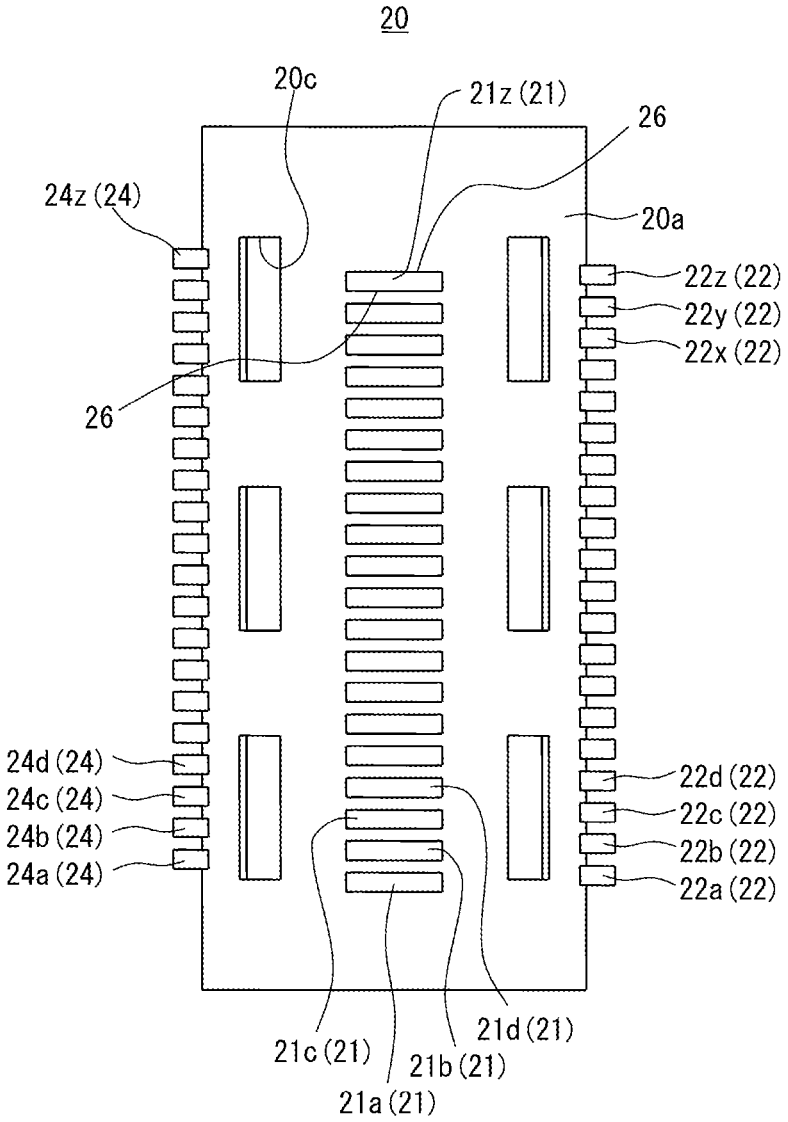
FIG. 4 is an elevation view illustrating the bobbin that the coil component according to the first exemplary embodiment has, showing the shape of the bobbin as viewed in the direction of the arrow A in FIG. 2.

As illustrated in any of FIGS. 2 to 4, the bobbin 20 includes a tubular bobbin body 20*a*, and plural position-limiting protruding portions arranged in plural portions on the outer peripheral surface of the bobbin body 20*a*.

In the case of this exemplary embodiment, the position-limiting protruding portions are arranged in a plurality of portions in the circumferential direction of the bobbin body 20*a* (in a direction around the axial center of the bobbin body 20*a*).

In addition, a plurality of the position-limiting protruding portions are arranged alongside each other along the axial direction of the bobbin body 20*a* at each of the plurality of portions in the circumferential direction of the bobbin body 20*a*.

More specifically, on the outer peripheral surface of the bobbin body 20*a*, plural position-limiting protruding portions 21, plural position-limiting protruding portions 22, plural position-limiting protruding portions 23 (see FIG. 3), and plural position-limiting protruding portions 24 are arranged.

The plural position-limiting protruding portions 21 are arranged alongside each other along the axial direction of the bobbin body 20*a* at one position in the circumferential direction of the bobbin body 20 *a*.

In a portion positionally shifted by 90 degrees in the circumferential direction of the bobbin body 20*a* from the portion where the plural position-limiting protruding portions 21 are arranged, the plural position-limiting protruding portions 22 are arranged alongside each other along the axial direction of the bobbin body 20*a*.

In a portion positionally shifted by 180 degrees in the circumferential direction of the bobbin body 20*a* from the portion where the plural position-limiting protruding portions 21 are arranged, the plural position-limiting protruding portions 23 are arranged alongside each other along the axial direction of the bobbin body 20*a*.

In a portion positionally shifted by 180 degrees in the circumferential direction of the bobbin body 20*a* from the portion where the plural position-limiting protruding portions 22 are arranged, the plural position-limiting protruding portions 24 are arranged alongside each other along the axial direction of the bobbin body 20*a*.

In this way, plural position-limiting protruding portions are arranged respectively at positions equiangularly spaced apart in the circumferential direction of the bobbin body 20*a*.

For example, the number of the position-limiting protruding portions 21, the number of the position-limiting protruding portions 22, the number of the position-limiting protruding portions 23, and the number of the position-limiting protruding portions 24 are equal to each other.

The bobbin 20 includes a position-limiting protruding portion 21*a*, a position-limiting protruding portion 21*b*, a position-limiting protruding portion 21*c*, and a position-limiting protruding portion 21*d* in the order they appear from the bottom in FIG. 4, each of which serves as the position-limiting protruding portion 21.

Figure 8:
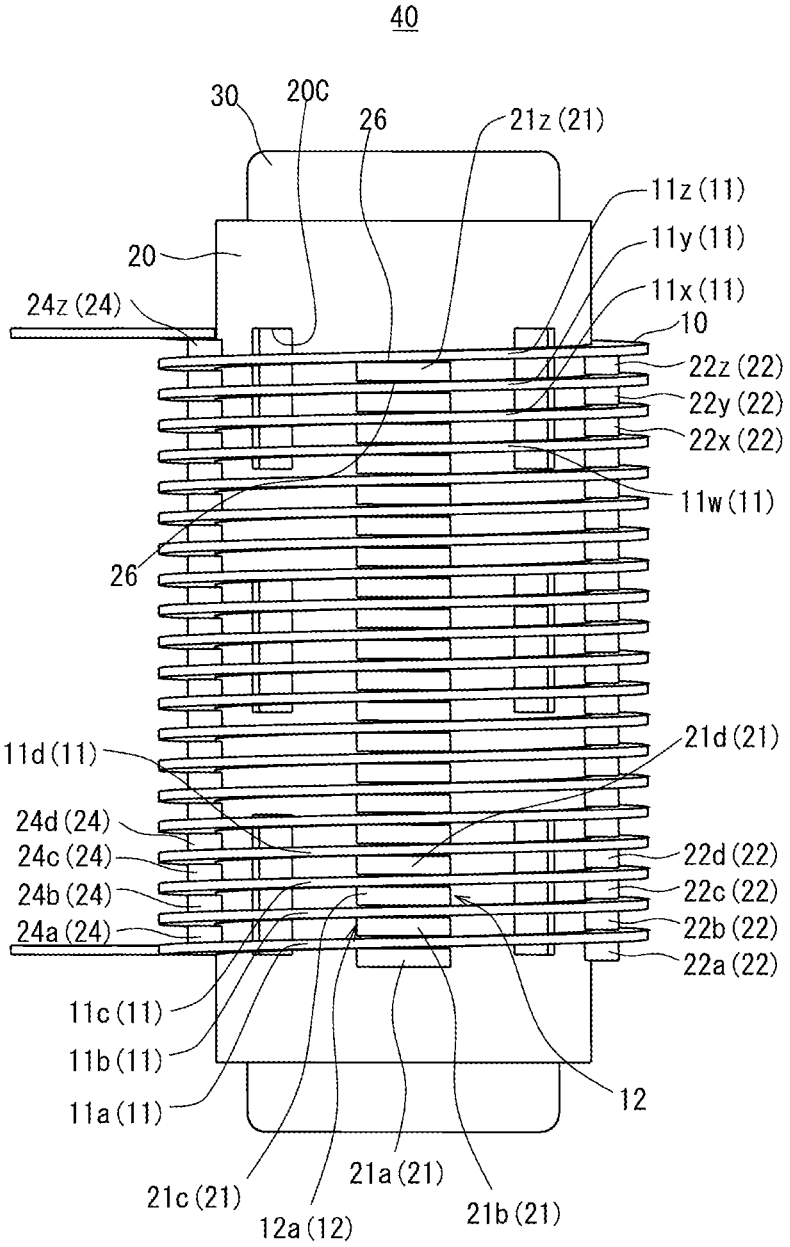
FIG. 8 is an elevation view illustrating the coil component according to the first exemplary embodiment.

Similarly, the bobbin 20 includes a position-limiting protruding portion 22*a*, a position-limiting protruding portion 22*b*, a position-limiting protruding portion 22*c*, and a position-limiting protruding portion 22*d* in the order they appear from the bottom in FIG. 8, each of which serves as the position-limiting protruding portion 22.

Similarly, the bobbin 20 includes a position-limiting protruding portion 23*a* (not illustrated), a position-limiting protruding portion 23*b* (not illustrated), a position-limiting protruding portion 23*c* (not illustrated), and a position-limiting protruding portion 23*d* (not illustrated) in the order from bottom to top in FIG. 8, each of which serves as the position-limiting protruding portion 23. Here, the reference characters 23*a*, 23*b*, 23*c*, and 23*d* are reference characters used for convenience sake and not illustrated in the drawings.

Similarly, the bobbin 20 includes a position-limiting protruding portion 24*a*, a position-limiting protruding portion 24*b*, a position-limiting protruding portion 24*c*, and a position-limiting protruding portion 24*d* in the order they appear from the bottom in FIG. 8, each of which serves as the position-limiting protruding portion 24.

In addition, the bobbin 20 includes a position-limiting protruding portion 22*z*, a position-limiting protruding portion 22*y*, and a position-limiting protruding portion 22*x* in the order they appear from the top in FIG. 8, each of which serves as the position-limiting protruding portion 22.

Furthermore, the bobbin 20 includes a position-limiting protruding portion 21*z* serving as the position-limiting protruding portion 21 and located at the uppermost position in FIG. 8.

Similarly, the bobbin 20 includes a position-limiting protruding portion 23*z* (not illustrated) serving as the position-limiting protruding portion 23 and located at the uppermost position in FIG. 8. Here, the reference character 23*z* is a reference character used for convenience sake and not illustrated in the drawings.

Similarly, the bobbin 20 includes a position-limiting protruding portion 24*z* serving as the position-limiting protruding portion 24 and located at the uppermost position in FIG. 8.

In FIG. 4, the position-limiting protruding portion 22*a* is disposed at a position higher than the position-limiting protruding portion 21*a*; the position-limiting protruding portion 23*a* (not illustrated) is disposed at a position higher than the position-limiting protruding portion 22*a*; the position-limiting protruding portion 24*a* is disposed at a position higher than the position-limiting protruding portion 23*a*; and the position-limiting protruding portion 21*b* is disposed at a position higher than the position-limiting protruding portion 24*a*.

Here, in the axial direction of the bobbin body 20*a*, the distance between the position-limiting protruding portion 21*a* and the position-limiting protruding portion 22*a*, the distance between the position-limiting protruding portion 22*a* and the position-limiting protruding portion 23*a*, the distance between the position-limiting protruding portion 23*a* and the position-limiting protruding portion 24*a*, and the distance between the position-limiting protruding portion 24*a* and the position-limiting protruding portion 21*b* are, for example, one quarter of the distance between the position-limiting protruding portion 21*a* and the position-limiting protruding portion 21*b*.

In addition, the position-limiting protruding portions 21 are each arranged at equal intervals in the axial direction of the bobbin body 20*a*.

Similarly, the position-limiting protruding portions 22 are each arranged at equal intervals in the axial direction of the bobbin body 20*a*.

Similarly, the position-limiting protruding portions 23 are each arranged at equal intervals in the axial direction of the bobbin body 20*a*.

Similarly, the position-limiting protruding portions 24 are each arranged at equal intervals in the axial direction of the bobbin body 20*a*.

Furthermore, the distance between adjacent position-limiting protruding portions 21, the distance between adjacent position-limiting protruding portions 22, the distance between adjacent position-limiting protruding portions 23, and the distance between adjacent position-limiting protruding portions 24 are equal to each other.

Thus, the position-limiting protruding portions of the bobbin 20 are arranged alongside each other along the spirally shaped path in the following order: the position-limiting protruding portion 21*a*, the position-limiting protruding portion 22*a*, the position-limiting protruding portion 23*a*, the position-limiting protruding portion 24*a*, the position-limiting protruding portion 21*b*, the position-limiting protruding portion 22*b*, the position-limiting protruding portion 23*b*, the position-limiting protruding portion 24*b*, the position-limiting protruding portion 21*c*, . . . .

As described above, the plurality of position-limiting protruding portions of the bobbin 20 are arranged along the spirally shaped path.

In the case of this exemplary embodiment, each of the position-limiting protruding portions is a rib elongated in the circumferential direction of the bobbin body 20*a*. That is, the position-limiting protruding portions each have the shape in which the size of each of the position-limiting protruding portions in the circumferential direction of the bobbin body 20*a* is larger than the size of each of the position-limiting protruding portions in the axial direction of the bobbin body 20*a*.

More specifically, the position-limiting protruding portions each have a pair of orthogonal surfaces 26 orthogonal to the axial direction of the bobbin body 20*a*. That is, in FIG. 4, the surface on the bottom side and the surface on the top side of each of the position-limiting protruding portions each serve as the orthogonal surface 26 (in FIG. 4, the reference character of the orthogonal surface 26 is attached only to the position-limiting protruding portion 21*z*).

As described above, the plural position-limiting protruding portions each have the orthogonal surfaces 26, each of which is orthogonal to the axial direction of the bobbin body 20*a*. The orthogonal surfaces 26 are formed into a flat plane shape.

The shape and the size of each of the position-limiting protruding portions are set, for example, so as to be equivalent to each other.

In the bobbin body 20*a*, for example, one or a plurality of openings 20*c* penetrating the inside and the outside of the bobbin main body 20*a* are formed. That is, a hollow portion 20*b*, which is the inside space of the bobbing body 20*a*, and the external space of the bobbin body 20*a* are communicated with each other through each of the opening 20*c*.

For example, in the circumferential direction of the bobbin body 20*a*, plural openings 20*c* are arranged respectively between the line of the plural position-limiting protruding portions 21 and the line of the plural position-limiting protruding portions 22, between the line of the plural position-limiting protruding portions 22 and the line of the plural position-limiting protruding portions 23, between the line of the plural position-limiting protruding portions 23 and the line of the plural position-limiting protruding portions 24, and between the line of the plural position-limiting protruding portions 24 and the line of the plural position-limiting protruding portions 21.

For example, the entire bobbin 20 including the bobbin body 20*a* and the plural position-limiting protruding portions (the plural position-limiting protruding portions 21, the plural position-limiting protruding portions 22, the plural position-limiting protruding portions 23, and the plural position-limiting protruding portions 24) is formed integrally using resin or other insulating, non-magnetic material.

In this exemplary embodiment, description is made of an example in which plural position-limiting protruding portions are arranged in each of four portions located in the circumferential direction of the bobbin body 20*a*. However, the present invention is not limited to this example. It may be possible that plural position-limiting protruding portions are arranged in each of two or three portions in the circumferential direction of the bobbin body 20*a*, or it may be possible that plural position-limiting protruding portions are arranged in each of five or more portions in the circumferential direction of the bobbin body 20*a*.

Furthermore, the present invention is not limited to the example in which position-limiting protruding portions are arranged in each of plural portions in the circumferential direction of the bobbin body 20*a*. It may be possible to employ a configuration in which plural position-limiting protruding portions are arranged in only one portion in the circumferential direction of the bobbin body 20*a*.

In addition, the present invention is not limited to the example in which plural position-limiting protruding portions are arranged alongside each other along the axial direction of the bobbin body 20*a* in each of plural portions located in the circumferential direction of the bobbin body 20*a*. It may be possible to employ a configuration in which one position-limiting protruding portion is disposed in each of plural portions located in the circumferential direction of the bobbin body 20*a*.

Moreover, the present invention is not limited to the example in which plural position-limiting protruding portions are arranged on the outer peripheral surface of the bobbin body 20*a*. It may be possible to employ a configuration in which one spirally shaped position-limiting protruding portion (rib) is formed on the outer peripheral surface of the bobbin body 20*a*. In this case, each part of the spirally shaped position-limiting protruding portion constitutes the first position-limiting protruding portion and the second position-limiting protruding portion.

Figure 5:
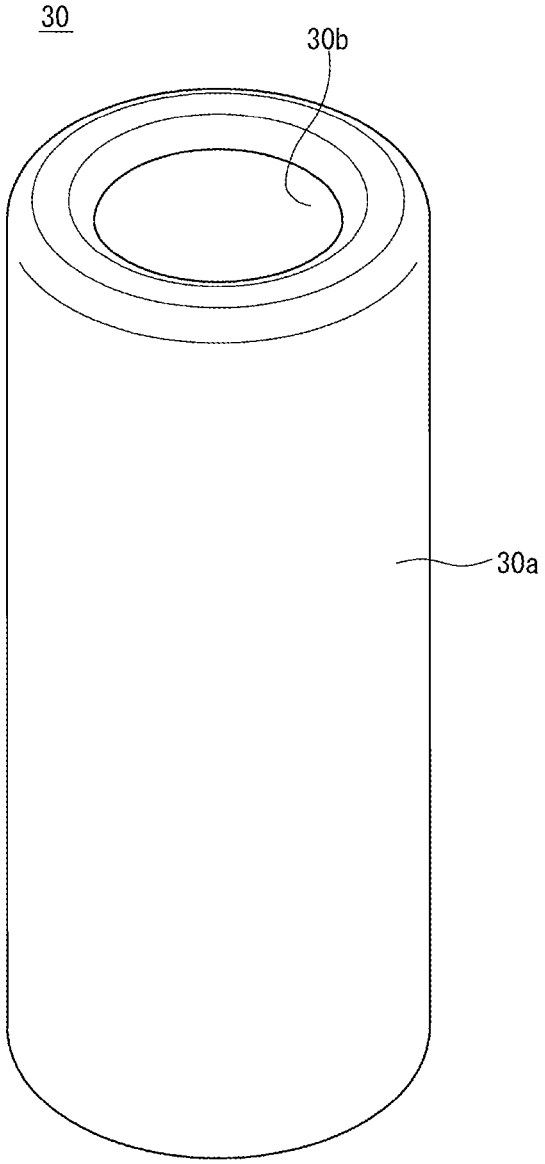
FIG. 5 is a perspective view illustrating a core that the coil component according to the first exemplary embodiment has.
Figure 6:
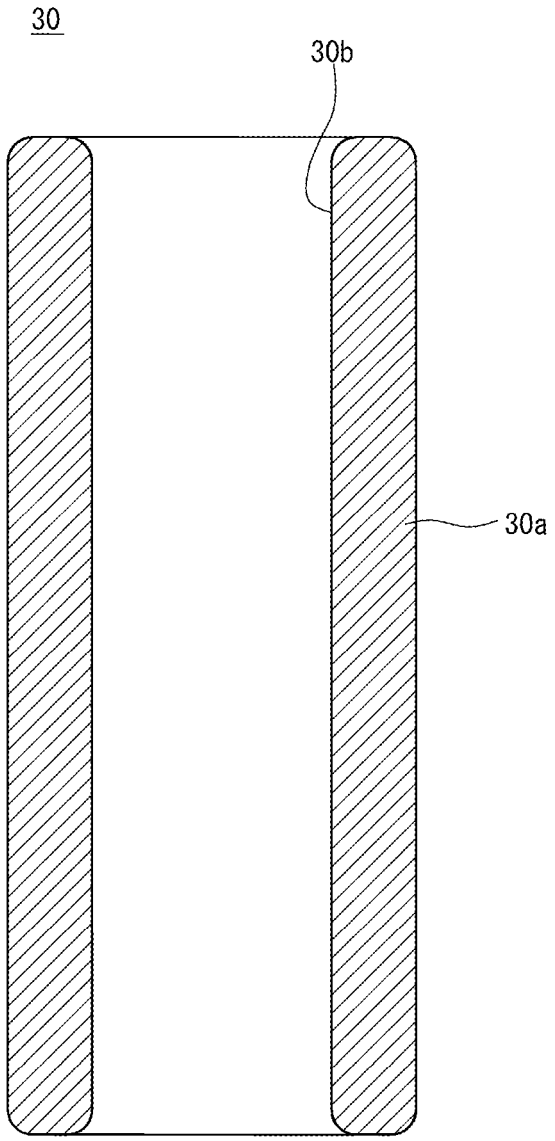
FIG. 6 is a front sectional view illustrating the core that the coil component according to the first exemplary embodiment has.

As illustrated in FIGS. 5 and 6, in the case of this exemplary embodiment, the core 30 is comprised of a tubular core body 30*a*. On the inner side of the core body 30*a*, a cylindrical hollow portion 30*b* is formed.

The outer diameter of the core 30 is smaller than the inner diameter of the bobbin body 20*a*.

Here, H (see FIG. 3) represents the projection length of the position-limiting protruding portion outward from the outer peripheral surface of the bobbin body 20*a* in the radial direction of the bobbin body 20*a* (the size of height of the position-limiting protruding portion), and R (see FIG. 3) represents the outer diameter of the bobbin body 20*a*. The inner diameter of the edgewise coil 10 is larger than the outer diameter R of the bobbin body 20*a*, and preferably, is less than (R+2H). In addition, it may be possible to set the inner diameter of the edgewise coil 10 to be less than (R+H). By setting the inner diameter of the edgewise coil 10 so as to be less than (R+2H), it is possible to more reliably engage the winding portions 11 of the edgewise coil 10 with the position-limiting protruding portions.

Figure 7:
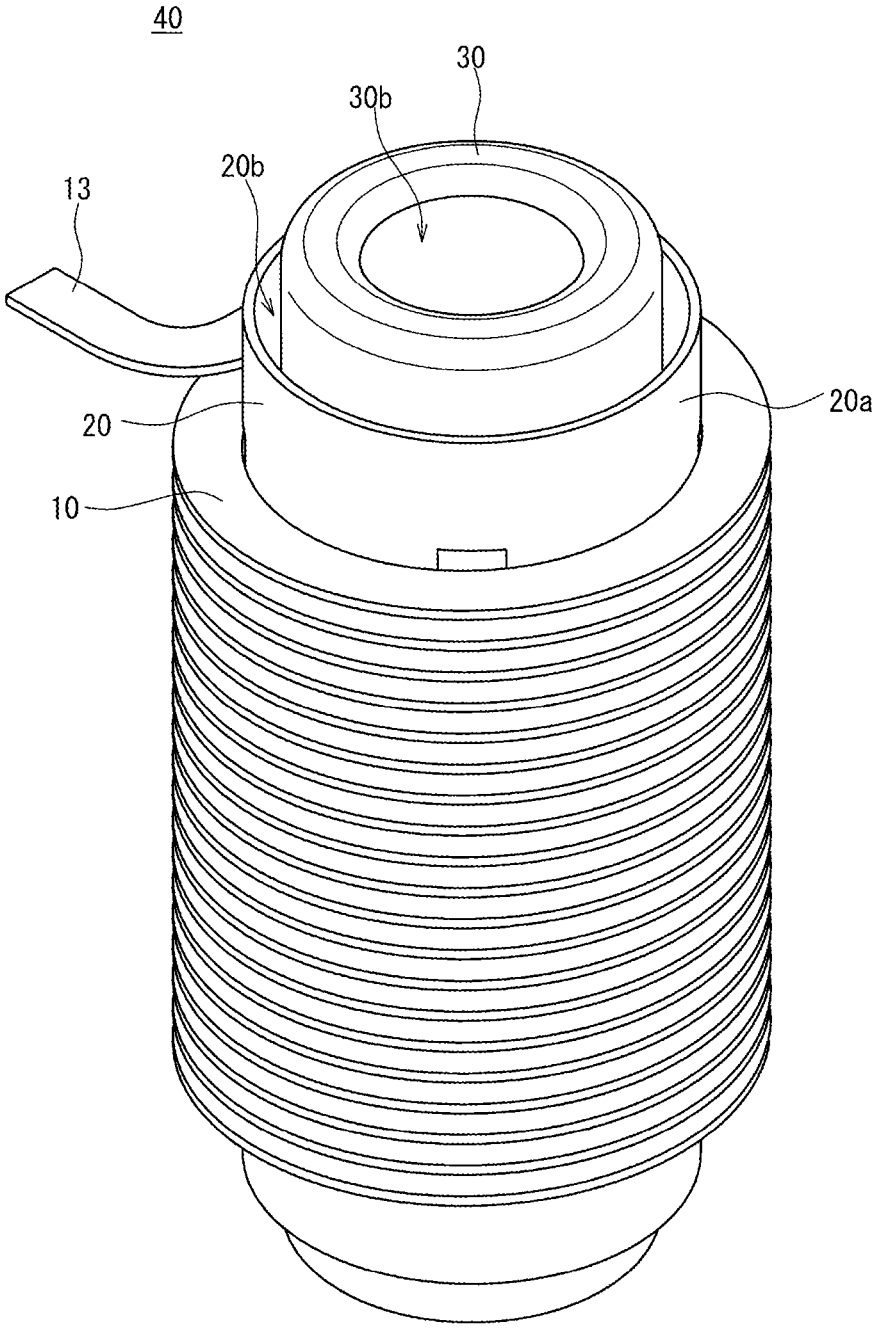
FIG. 7 is a perspective view illustrating the coil component according to the first exemplary embodiment.

As illustrated in FIGS. 7 and 8, the coil component 40 is configured by winding the edgewise coil 10 around the bobbin body 20*a* and inserting the core 30 into the hollow portion 20*b* of the bobbin 20.

As illustrated in FIG. 8, each of the winding portions 11 of the edgewise coil 10 is disposed between position-limiting protruding portions adjacent to each other in the axial direction of the bobbin body 20*a*.

Here, the edgewise coil 10 includes a winding portion 11*a*, a winding portion 11*b*, a winding portion 11*c*, and a winding portion 11*d* in the order they appear from the bottom in FIG. 8.

Furthermore, the edgewise coil 10 includes a winding portion 11*z*, a winding portion 11*y*, a winding portion 11*x*, and a winding portion 11*w* in the order they appear from the top in FIG. 8.

Of these winding portions, the winding portion 11*a* passes through, for example, between the position-limiting protruding portion 21*a* and the position-limiting protruding portion 21*b*, between the position-limiting protruding portion 22*a* and the position-limiting protruding portion 22*b*, and between the position-limiting protruding portion 23*a* (not illustrated) and the position-limiting protruding portion 23*b* (not illustrated), and then, reaches a portion between the position-limiting protruding portion 24*a* and the position-limiting protruding portion 24*b*.

Similarly, the winding portion 11*b* passes through between the position-limiting protruding portion 21*b* and the position-limiting protruding portion 21*c*, between the position-limiting protruding portion 22*b* and the position-limiting protruding portion 22*c*, and between the position-limiting protruding portion 23*b* (not illustrated) and the position-limiting protruding portion 23*c* (not illustrated), and then, reaches a portion between the position-limiting protruding portion 24*b* and the position-limiting protruding portion 24*c*.

Similarly, the winding portion 11*c* passes through between the position-limiting protruding portion 21*c* and the position-limiting protruding portion 21*d*, between the position-limiting protruding portion 22*c* and the position-limiting protruding portion 22*d*, and between the position-limiting protruding portion 23*c* (not illustrated) and the position-limiting protruding portion 23*d* (not illustrated), and then, reaches a portion between the position-limiting protruding portion 24*c* and the position-limiting protruding portion 24*d*.

Other winding portions 11 of the edgewise coil 10 similarly pass sequentially through between position-limiting protruding portions adjacent to each other in the axial direction of the bobbin 20.

Thus, the path of the wire 10*a* forming the edgewise coil 10 is limited to the spirally shaped path by the plural position-limiting protruding portions of the bobbin 20.

In addition, a space 12 exists between winding portions 11 adjacent to each other of the edgewise coil 10. In other words, the edgewise coil 10 is in a state of space winding (in a state of pitch winding).

Figure 9:
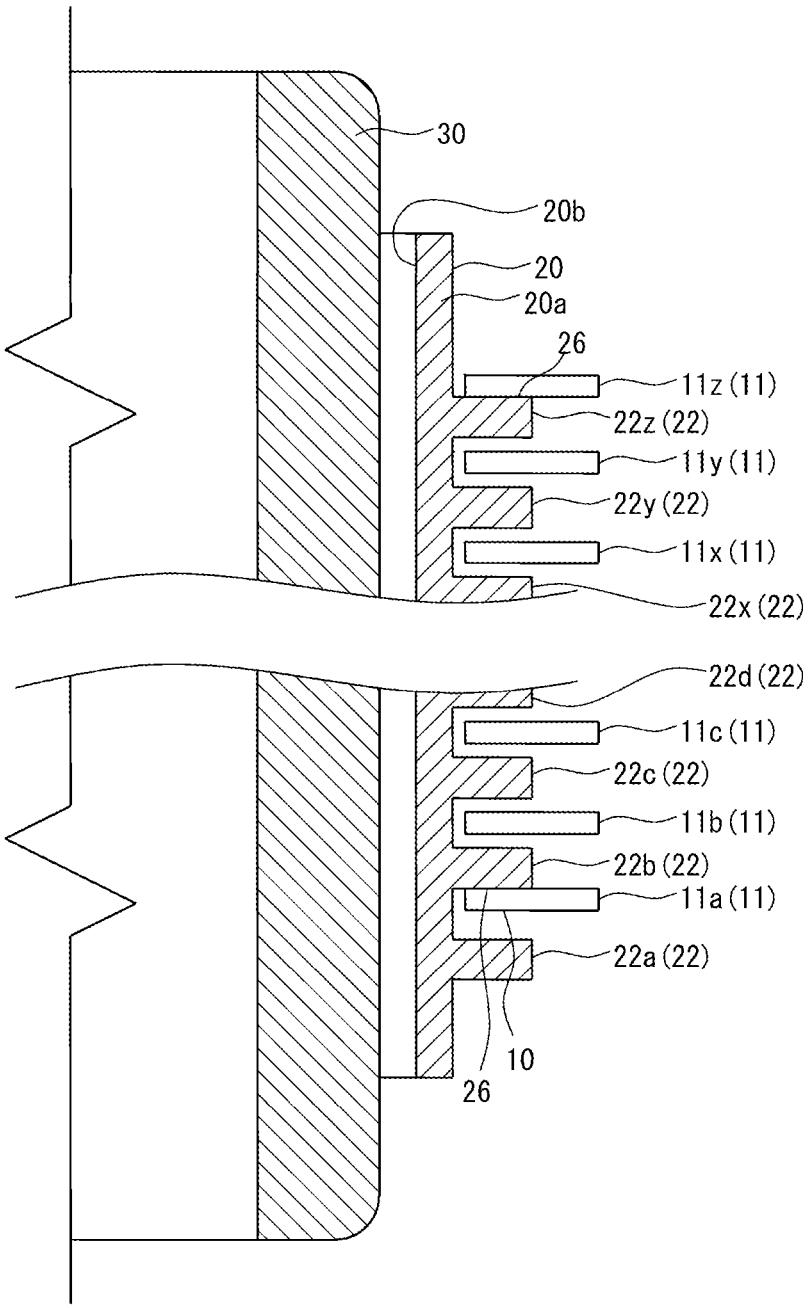
FIG. 9 is a front sectional view illustrating the coil component according to the first exemplary embodiment.

More specifically, for example, as illustrated in FIG. 9, the winding portion 11*a* of the edgewise coil 10 is in pressure contact with the position-limiting protruding portion 22*b* toward the top side in FIG. 9 (in other words, toward the position-limiting protruding portion 22*z*). Meanwhile, the winding portion 11*z* of the edgewise coil 10 is in pressure contact with the position-limiting protruding portion 22*z* toward the bottom side in FIG. 9 (in other words, toward the position-limiting protruding portion 22*b*).

In addition, the winding portion 11*a* of the edgewise coil 10 is in pressure contact with the position-limiting protruding portion 21*b* towards the position-limiting protruding portion 21*z*, although no detailed illustration is given. Meanwhile, the winding portion 11*z* of the edgewise coil 10 is in pressure contact with the position-limiting protruding portion 21*z* toward the position-limiting protruding portion 21*b*.

Furthermore, although no illustration is given, the winding portion 11*a* of the edgewise coil 10 is in pressure contact with the position-limiting protruding portion 23*b* toward the position-limiting protruding portion 23*z*. Meanwhile, the winding portion 11*z* of the edgewise coil 10 is in pressure contact with the position-limiting protruding portion 23*z* toward the position-limiting protruding portion 23*b*.

Moreover, although no detailed illustration is given, the winding portion 11*a* of the edgewise coil 10 is in pressure contact with the position-limiting protruding portion 24*b* toward the position-limiting protruding portion 24*z*. Meanwhile, the winding portion 11*z* of the edgewise coil 10 is in pressure contact with the position-limiting protruding portion 24*z* toward the position-limiting protruding portion 24*b*.

As described above, the plural position-limiting protruding portions include the first position-limiting protruding portion (for example, the position-limiting protruding portion 21*b*, 22*b*, 23*b*, 24*b*) and the second position-limiting protruding portion (the position-limiting protruding portion 21*z*, 22*z*, 23*z*, 24*z*) that are disposed at positions different from each other in the axial direction of the bobbin body 20*a*. In addition, the edgewise coil 10 includes the first winding portion (for example, the winding portion 11*a*) that is in pressure contact with the first position-limiting protruding portion toward the second position-limiting protruding portion, and the second winding portion (for example, the winding portion 11*z*) that is in pressure contact with the second position-limiting protruding portion toward the first position-limiting protruding portion.

More specifically, the first winding portion (for example, the winding portion 11*a*) is in pressure contact with the orthogonal surface 26 (in particular, the surface on the bottom side of the first position-limiting protruding portion in FIGS. 8 and 9) of the first position-limiting protruding portion (for example, the position-limiting protruding portion 21*b*, 22*b*, 23*b*, 24*b*), and the second winding portion (for example, the winding portion 11*z*) is in pressure contact with the orthogonal surface 26 (in particular, the surface on the top side of the second position-limiting protruding portion in FIGS. 8 and 9) of the second position-limiting protruding portion.

Thus, the first winding portion and the second winding portion are substantially in surface contact with the first position-limiting protruding portion and the second position-limiting protruding portion, respectively.

This configuration more reliably reduces the positional displacement of the first winding portion and the second winding portion relative to the first position-limiting protruding portion and the second position-limiting protruding portion, respectively.

In addition, the winding portions 11 (for example, the winding portion 11*b*, 11*c*, 11*x*, 11*y* and the like illustrated in FIG. 9) other than the first winding portion (for example, the winding portion 11*a*) and the second winding portion (for example, the winding portion 11*z*) are disposed, for example, between position-limiting protruding portions 21 adjacent to each other in the axial direction of the bobbin body 20*a*, between position-limiting protruding portions 22 adjacent to each other in the axial direction of the bobbin body 20*a*, between position-limiting protruding portions 23 adjacent to each other in the axial direction of the bobbin body 20*a*, and between position-limiting protruding portions 24 adjacent to each other in the axial direction of the bobbin body 20*a*, respectively, and are not in contact with any of position-limiting protruding portions.

With this configuration, winding portions 11 from the first winding portion (for example, the winding portion 11*a*) to the second winding portion (for example, the winding portion 11*z*) are arranged equally (substantially at equal intervals) in the axial direction of the bobbin body 20*a*.

However, it may be possible that part of the winding portions 11 other than the first winding portion (for example, the winding portion 11*a*) and the second winding portion (for example, the winding portion 11*z*) is in contact with any of position-limiting protruding portions.

In the example illustrated in FIGS. 8 and 9, surplus position-limiting protruding portions 21, 22, and 23 (the position-limiting protruding portions 21*a*, 22*a*, 23*a* (not illustrated)) exist on one side (the bottom side) of the bobbin body 20*a* in the axial direction. However, these surplus position-limiting protruding portions may not exist.

In addition, surplus position-limiting protruding portions may exist on both sides of the bobbin body 20*a* in the axial direction.

Description has been made with reference to FIG. 9 of an example in which the winding portions 11 (winding portions 11*a* and 11*z*) on both ends of the edgewise coil 10 are each in pressure contact with the position-limiting protruding portion. However, it may be possible that a surplus winding portion 11 exists on both sides or one side of the edgewise coil 10, and a winding portion 11 that is not an end portion of the edgewise coil 10 is in pressure contact with a position-limiting protruding portion.

Figure 10:
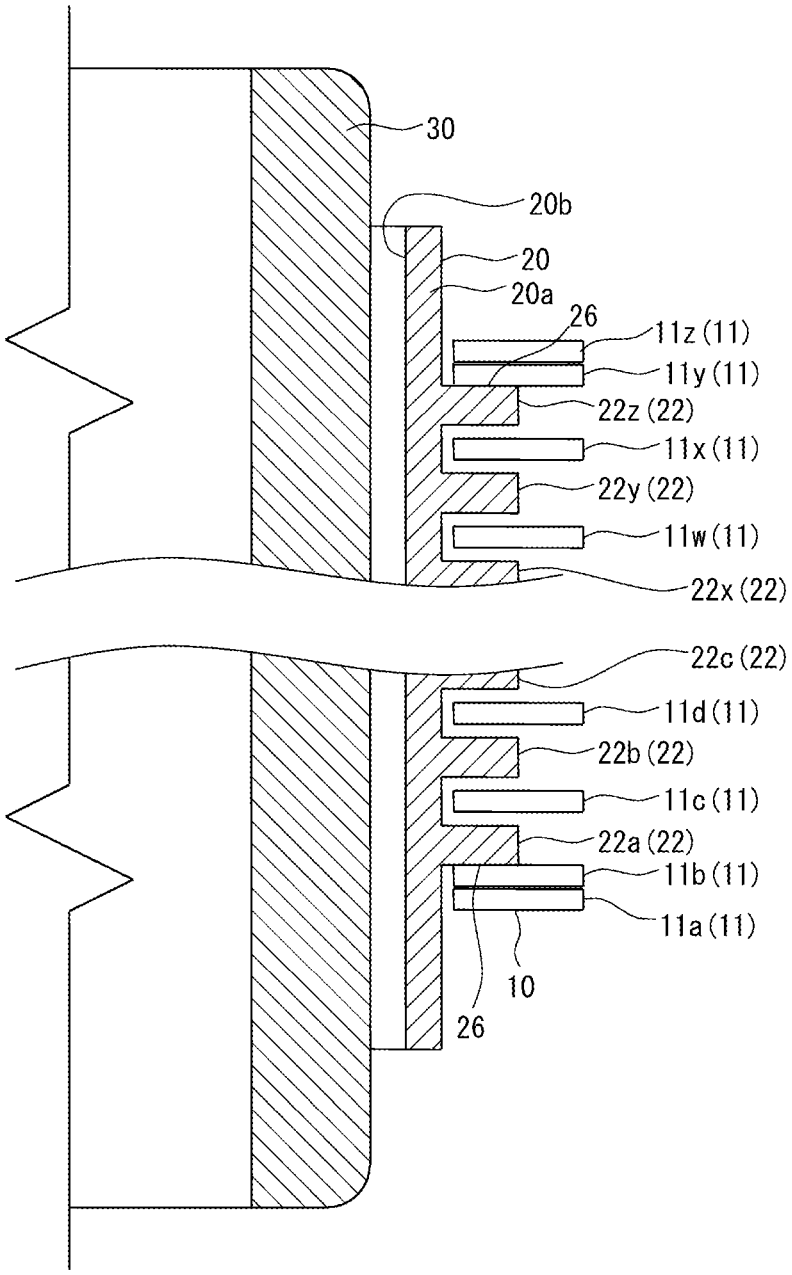
FIG. 10 is a front sectional view illustrating a coil component according to a modification example of the first exemplary embodiment.

That is, for example, as illustrated in FIG. 10, it may be possible that the winding portion 11*b* is in pressure contact with the position-limiting protruding portion 22*a* toward the position-limiting protruding portion 22*z*, and the winding portion 11*y* is in pressure contact with the position-limiting protruding portion 22*z* toward the position-limiting protruding portion 22*a*. In this case, the winding portion 11*b* serves as the first winding portion, and the winding portion 11*y* serves as the second winding portion. In addition, the position-limiting protruding portion 22*a* serves as the first position-limiting protruding portion, and the position-limiting protruding portion 22*z* serves as the second position-limiting protruding portion.

In this case, a surplus winding portion 11 may be tightly wound in a manner such that the excess winding portion 11 is in close contact with an adjacent winding portion 11. At least, in the axial direction of the bobbin body 20*a*, the space between a surplus winding portion 11 and a winding portion 11 adjacent to the surplus winding portion 11 is narrower than each of the spaces between winding portions 11 adjacent to each other of the winding portions from the first winding portion to the second winding portion.

Figure 11:
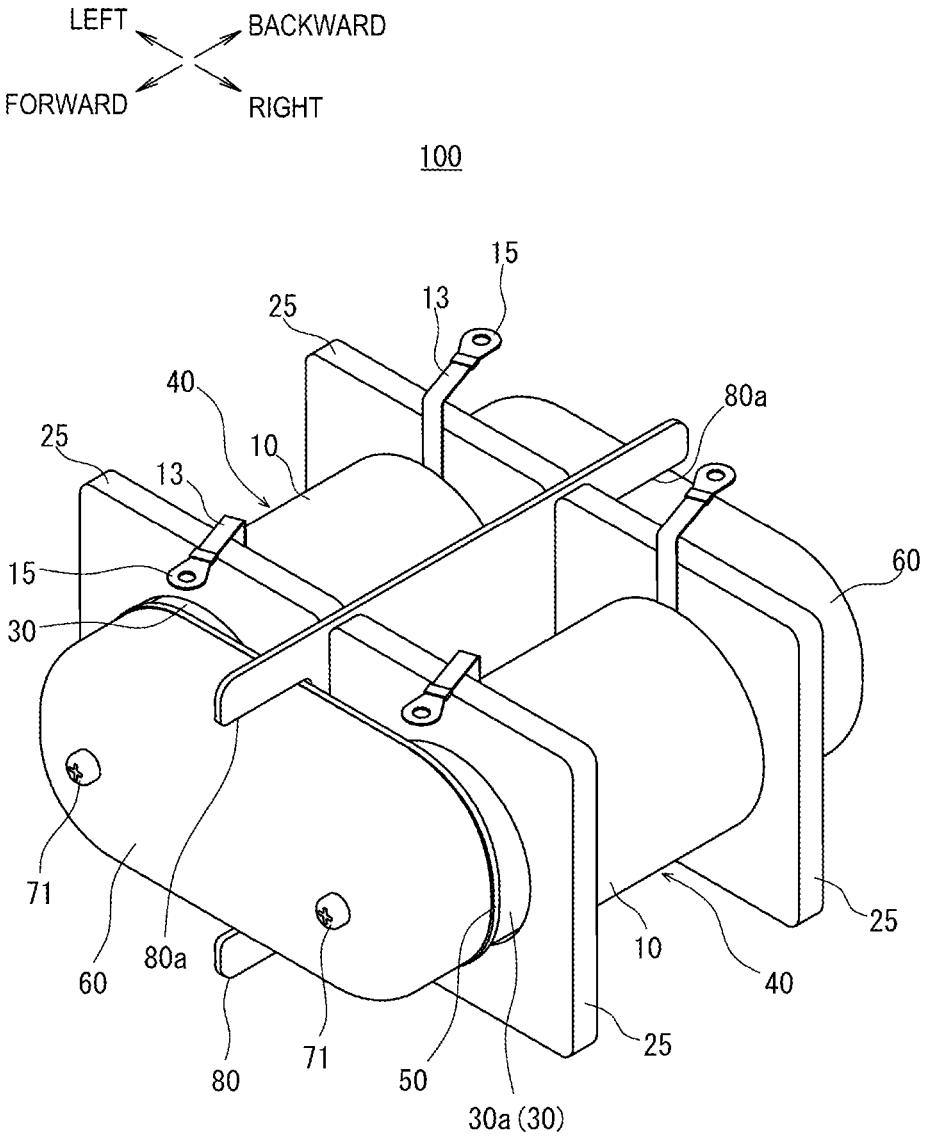
FIG. 11 is a perspective view illustrating a coil component unit including the coil component according to the first exemplary embodiment.
Figure 12:
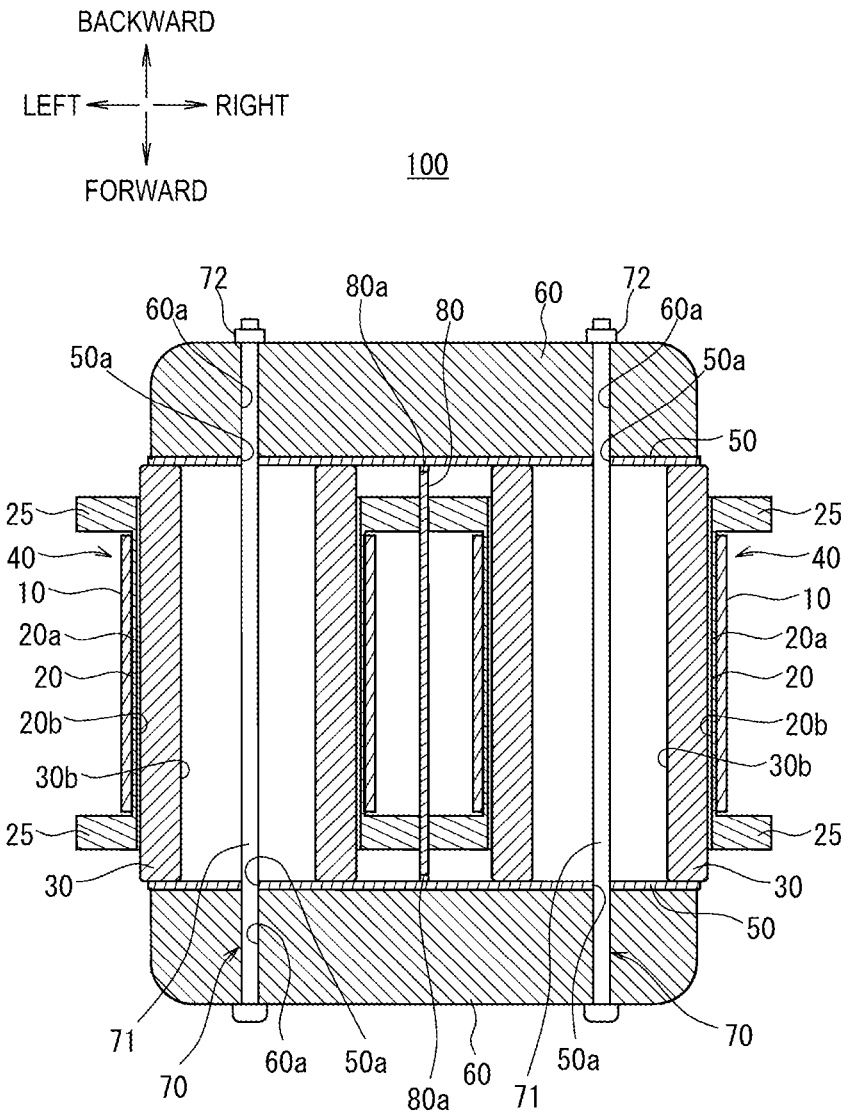
FIG. 12 is a sectional plan view illustrating the coil component unit including the coil component according to the first exemplary embodiment.

FIGS. 11 and 12 are diagrams each illustrating a coil component unit 100 formed by making plural (for example, two) coil components 40 into a unit. FIG. 11 is a perspective view and FIG. 12 is a sectional plan view. As for the positional relationship of the coil component unit 100 in each of FIGS. 11 and 12, the directions of forward, backward, left, and right are shown in each drawing. These directions are used only to illustrate the structure of the coil component unit 100, and do not necessarily correspond to the positional relationships of the coil component unit 100 during manufacturing or when in use.

Here, in FIGS. 2 to 4 and FIGS. 7 to 10, a flange portion 25 (see FIGS. 11 and 12) of the bobbin 20 is not illustrated. However, the bobbin 20 includes a pair of flange portions 25 each provided on both ends of the bobbin body 20*a* in the axial direction. The flange portion 25 is formed into a rectangular shape such as a square shape.

In addition, as illustrated in FIGS. 7, 8, and 12, in the axial direction of the bobbin body 20*a*, the longitudinal dimension of the core 30 is longer than that of the bobbin 20, and the end portion of the core 30 protrudes from each end of the bobbin 20.

Here, the two coil components 40 of the coil component unit 100 are arranged in parallel so that the axial directions of bobbin bodies 20*a* of these coil components 40 extend in parallel to each other.

In addition, a flat plate-like partitioning plate 80 is disposed between the two coil components 40.

In the axial direction of the bobbin body 20*a*, both ends of the partitioning plate 80 are each provided with a cutout-shaped portion 80*a* having a shape obtained by cutting out a rectangular-shaped portion from the partitioning plate 80.

As illustrated in FIG. 12, a flat plate-like spacer 50 is disposed at both ends of the coil component 40 in the axial direction of the bobbin body 20*a*.

In addition, a holding member 60 is disposed at positions located outside of the spacer 50 in the axial direction of the bobbin body 20*a* (at a position located in front of the forward-side spacer 50 in FIG. 12 and at a position located behind the backward-side spacer 50 in FIG. 12).

That is, the coil component unit 100 includes a pair of spacers 50 and a pair of holding members 60.

Each of the holding members 60 and the spacers 50 is used to fix both of the two coil components 40 of the coil component unit 100.

The spacers 50 and the holding members 60 each have an insertion hole 50*a* and an insertion hole 60*a*, respectively, formed therein. A bolt 71 is inserted into the insertion hole 50*a* and the insertion hole 60*a* of each of the spacers 50 and the holding members 60, respectively, located at both ends of the coil components 40 and also into the hollow portion 30*b* of the core 30. A nut 72 is tightened at the tip end side of the bolt 71. With this configuration, a pair of holding members 60, a pair of spacers 50, and the coil components 40 are fixed to each other with a fastening member 70 including the bolt 71 and the nut 72.

That is, by fastening the bolt 71 and the nut 72 together, both ends of the core 30 are sandwiched by the pair of holding members 60 via the spacers 50, respectively.

The spacer 50 on one side and a holding member 60 adjacent to this spacer 50 are disposed so as to penetrate through a plate surface of the partitioning plate 80 through the cutout-shaped portion 80*a* on one side (penetrate in the right and left direction in FIG. 11 and FIG. 12).

Similarly, the spacer 50 on the other side and a holding member 60 adjacent to this spacer 50 are disposed so as to penetrate through a plate surface of the partitioning plate 80 through the cutout-shaped portion 80*a* on the other side (penetrate in the right and left direction in FIG. 11 and FIG. 12).

In addition, a terminal portion 15 for external connection is provided at the outwardly extending pieces 13 at both ends of the edgewise coil 10 of each of the coil components 40.

Figure 13:
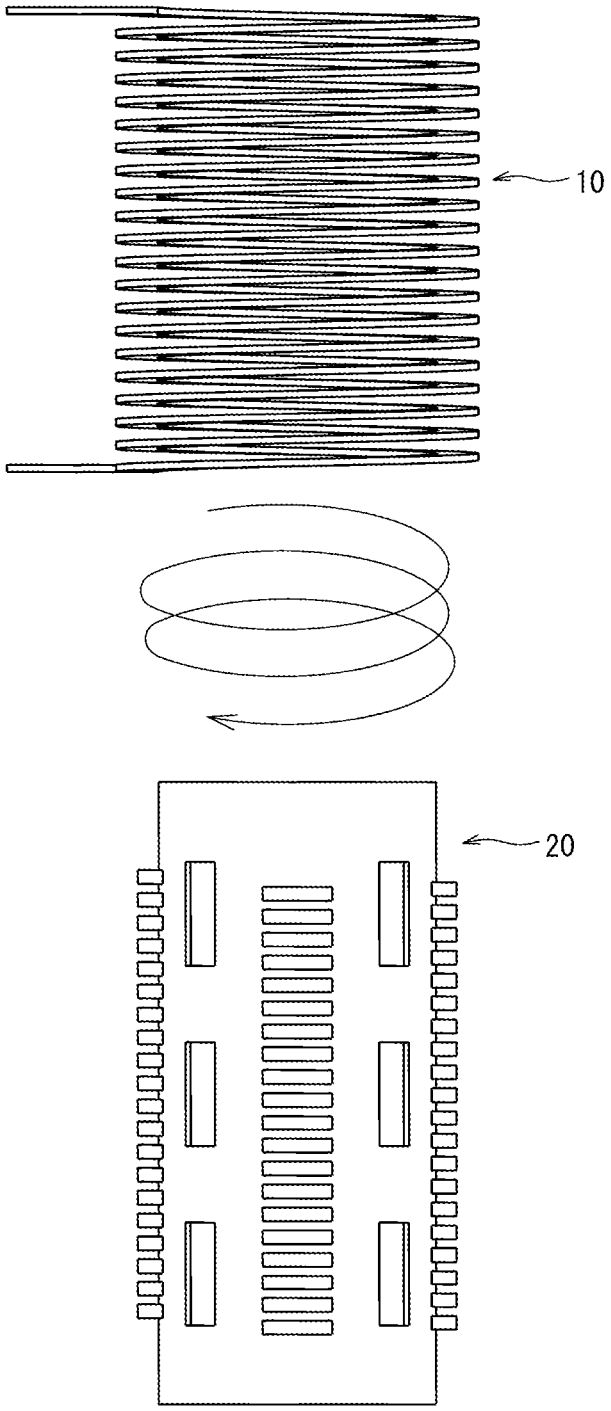
FIG. 13 is an explanatory view illustrating a method for manufacturing the coil component according to the first exemplary embodiment.

The coil component 40 according to this exemplary embodiment can be manufactured by screwing a bobbin 20 to a fixed edgewise coil 10 as illustrated, for example, in FIG. 13, and inserting a core 30 into the bobbin 20.

That is, the method for manufacturing a coil component according to this exemplary embodiment is a method for manufacturing the coil component 40 by winding the edgewise coil 10 around the bobbin 20. This method includes: preparing the bobbin 20, which includes: the tubular bobbin body 20*a*; and the plurality of position-limiting protruding portions arranged in the plurality of portions on the outer peripheral surface of the bobbin body 20*a* and limiting the position of each winding portion 11 of the edgewise coil 10 in the axial direction of the bobbin body 20*a*. The plurality of position-limiting protruding portions include a first position-limiting protruding portion and a second position-limiting protruding portion, which are disposed at positions different from each other in the axial direction of the bobbin body 20*a*. The method further includes winding the edgewise coil 10 around the bobbin 20 by screwing the bobbin 20 and the edgewise coil 10 with each other, in a manner such that: the edgewise coil 10 includes a first winding portion that is in pressure contact with the first position-limiting protruding portion toward the second position-limiting protruding portion and a second winding portion that is in pressure contact with the second position-limiting protruding portion toward the first position-limiting protruding portion; and the edgewise coil 10 is in a state of space winding in which respective winding portions 11 from the first winding portion and the second winding portion are spaced apart from each other in the axial direction of the bobbin body 20*a*.

Here, when the bobbin 20 and the edgewise coil 10 are screwed with each other, the edgewise coil 10 extends in the axial direction of the bobbin body 20*a* due to drag that the winding portions 11 of the edgewise coil 10 receives from the plural position-limiting protruding portions. As a result, the first winding portion of the edgewise coil 10 is brought into pressure contact with the first position-limiting protruding portion toward the second position-limiting protruding portion, and the second winding portion of the edgewise coil 10 is brought into pressure contact with the second position-limiting protruding portion toward the first position-limiting protruding portion.

As described above, the winding the edgewise coil 10 around the bobbin 20 is performed while the edgewise coil 10 is being caused to extend in the axial direction of the bobbin body 20*a* using drag that each of the winding portions 11 of the edgewise coil 10 receives from the plurality of position-limiting protruding portions.

Before the edgewise coil 10 is screwed with the bobbin 20, the edgewise coil 10 may be tightly wound in a manner such that adjacent winding portions 11 are in close contact with each other.

In addition, if there are variations in spaces between winding portions 11 of the edgewise coil 10 before the edgewise coil 10 is screwed with the bobbin 20, these spaces between winding portions 11 can be equalized by limiting positions of the winding portions 11 using the plural position-limiting protruding portions arranged at equal intervals in the axial direction of the bobbin body 20*a*.

According to the first exemplary embodiment as described above, the first winding portion of the edgewise coil 10 is in pressure contact with the first position-limiting protruding portion toward the second position-limiting protruding portion, and the second winding portion of the edgewise coil 10 is in pressure contact with the second position-limiting protruding portion toward the first position-limiting protruding portion. With this configuration, it is possible to stably determine the positions of the first winding portion and the second winding portion with respect to the first position-limiting protruding portion and the second position-limiting protruding portion, respectively. Thus, it is possible to more stably maintain the positions of each of the winding portions 11 of the edgewise coil 10, and it is possible to more reliably achieve the coil component 40 having a high quality factor.

Second Exemplary Embodiment

Figure 14:
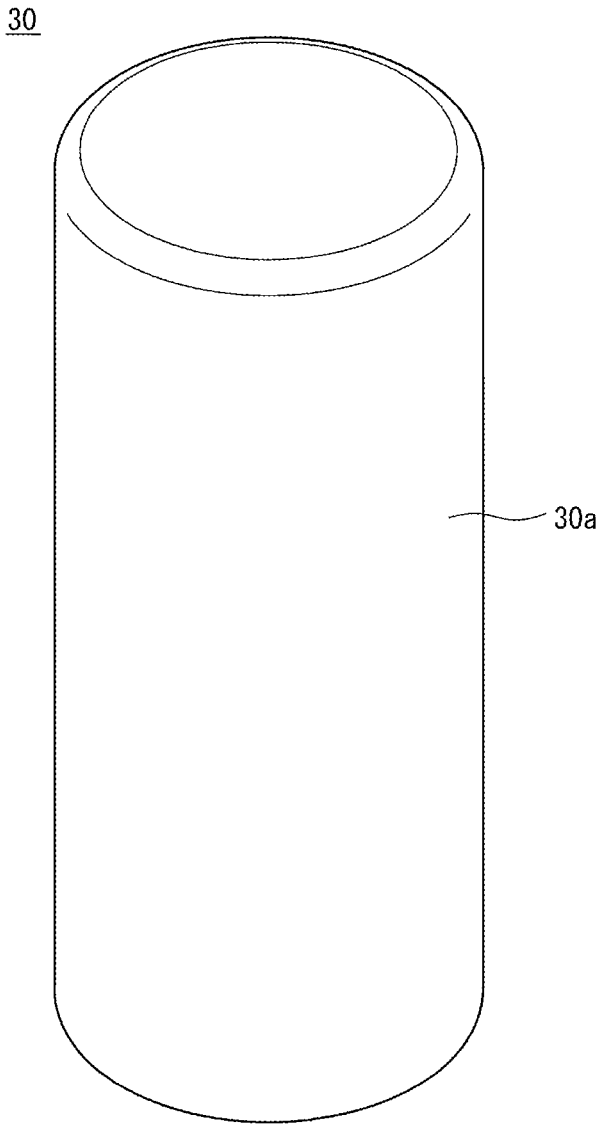
FIG. 14 is a perspective view illustrating a core that a coil component according to a second exemplary embodiment has.
Figure 15:
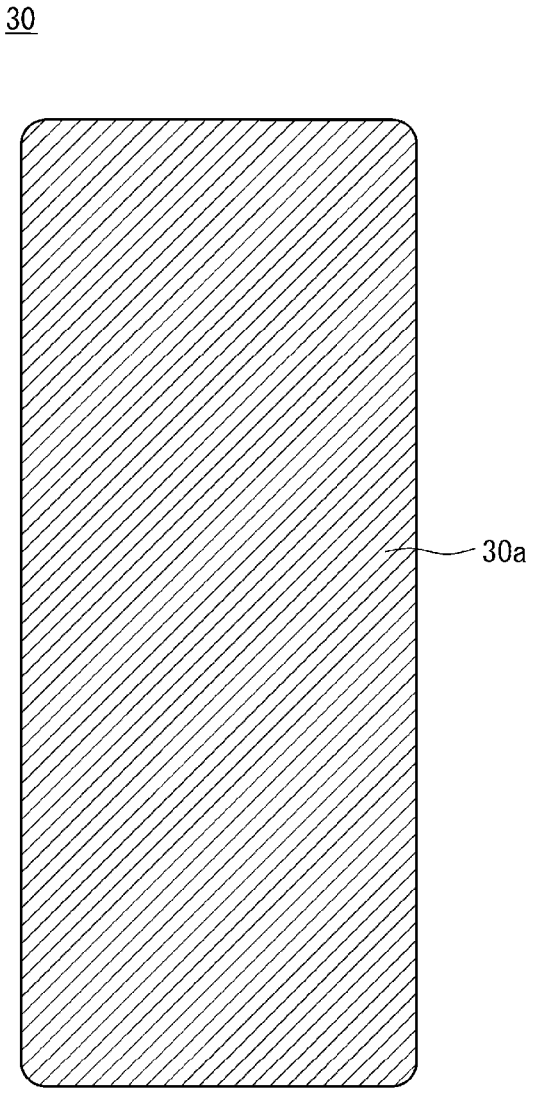
FIG. 15 is a front sectional view illustrating the core that the coil component according to the second exemplary embodiment has.

As illustrated in FIGS. 14 and 15, a coil component according to the second exemplary embodiment is different from the coil component 40 according to the first exemplary embodiment in that the core 30 (core body 30*a*) is formed into a cylindrical column shape (rather than the tubular shape), and in other points, is configured in a similar manner to the coil component 40 according to the first exemplary embodiment.

These are descriptions of each of the exemplary embodiments with reference to the drawings. However, these are merely examples of the present invention, and it may be possible to employ various configurations other than those described above. In addition, it may be possible to combine the exemplary embodiments described above as appropriate without departing from the main points of the present invention.

The present exemplary embodiment includes the following technical ideas.

(1) A coil component, including:

an edgewise coil; and a bobbin around which the edgewise coil is wound, in which the bobbin includes:

a tubular bobbin body; and a plurality of position-limiting protruding portions arranged in a plurality of portions on an outer peripheral surface of the bobbin body and limiting a position of a winding portion of the edgewise coil in an axial direction of the bobbin body, the plurality of position-limiting protruding portions include a first position-limiting protruding portion and a second position-limiting protruding portion that are disposed at positions different from each other in the axial direction of the bobbin body, the edgewise coil includes:

a first winding portion that is in pressure contact with the first position-limiting protruding portion toward the second position-limiting protruding portion; and a second winding portion that is in pressure contact with the second position-limiting protruding portion toward the first position-limiting protruding portion, and the edgewise coil is in a state of space winding in which respective winding portions from the first winding portion to the second winding portion are spaced apart from each other in the axial direction of the bobbin body.

(2) The coil component according to (1), in which the position-limiting protruding portions are arranged in a plurality of portions in a circumferential direction of the bobbin body.

(3) The coil component according to (2), in which a plurality of said position-limiting protruding portions are arranged alongside each other along the axial direction of the bobbin body at each of the plurality of portions in the circumferential direction of the bobbin body.

(4) The coil component according to (2) or (3), in which the plurality of position-limiting protruding portions are arranged along a spirally shaped path.

(5) The coil component according to any one of (1) to (4), in which each of the plurality of position-limiting protruding portions has an orthogonal surface orthogonal to the axial direction of the bobbin body, and the first winding portion is in pressure contact with the orthogonal surface of the first position-limiting protruding portion, while the second winding portion is in pressure contact with the orthogonal surface of the second position-limiting protruding portion.

(6) A method for manufacturing a coil component by winding an edgewise coil around a bobbin, the method including:

preparing a bobbin including:

a tubular bobbin body; and a plurality of position-limiting protruding portions arranged in a plurality of portions on an outer peripheral surface of the bobbin body and limiting a position of each winding portion of the edgewise coil in an axial direction of the bobbin body, the plurality of position-limiting protruding portions including a first position-limiting protruding portion and a second position-limiting protruding portion that are disposed at positions different from each other in the axial direction of the bobbin body; and winding the edgewise coil around the bobbin by screwing the bobbin and the edgewise coil with each other, in a manner such that:

the edgewise coil includes:

a first winding portion that is in pressure contact with the first position-limiting protruding portion toward the second position-limiting protruding portion; and a second winding portion that is in pressure contact with the second position-limiting protruding portion toward the first position-limiting protruding portion, and the edgewise coil is in a state of space winding in which respective winding portions from the first winding portion to the second winding portion are spaced apart from each other in the axial direction of the bobbin body.

(7) The method for manufacturing a coil component according to (6), in which the winding the edgewise coil around the bobbin is performed while the edgewise coil is being caused to extend in the axial direction of the bobbin body using drag that each of the winding portions of the edgewise coil receives from the plurality of position-limiting protruding portions.

This application is based on Japanese Patent Application No. 2017-012701, filed on Jan. 27, 2017, the entire content of which is incorporated hereinto by reference.

What is claimed is:

1. A coil component, comprising:

an edgewise coil extending in an axial direction, the edgewise coil being formed by winding a flat wire, the edgewise coil having a first winding portion at one end side of the edgewise coil along the axial direction and a second winding portion at the other end side of the edgewise coil along the axial direction; and a bobbin around which the edgewise coil is wound, the bobbin including:

a tubular bobbin body extending in the axial direction; and a plurality of position-limiting protrusions arranged along the axial direction on an outer peripheral surface of the bobbin body, each of the plurality of position-limiting protrusions secure a position of each winding portion of the edgewise coil in the axial direction, each of the plurality of position-limiting protrusions having first and second outer walls opposite to each other in the axial direction, the first outer wall and the second outer wall facing in opposite directions, wherein the first winding portion is in pressure contact with only the first outer wall of a first corresponding protrusion of the plurality of position-limiting protrusions, and the second winding portion is in pressure contact with only the second outer wall of a second corresponding protrusion of the plurality of position-limiting protrusions, and the edgewise coil is in a state of space winding in which respective winding portions are spaced apart from each other in the axial direction.

2. The coil component according to claim 1, wherein the edgewise coil is configured by the first winding portion, the second winding portion, and the remaining winding portions, and are located between the first outer wall of the first corresponding protrusion and the second outer wall of the second corresponding protrusion along the axial direction.

3. The coil component according to claim 1, wherein the plurality of position-limiting protrusions is configured with a plurality of groups of the position-limiting protrusions, each of the plurality of groups of the position-limiting protrusions is arranged at different positions on the outer peripheral surface of the bobbin body in a circumferential direction of the bobbin body.

4. The coil component according to claim 3, wherein each of the plurality of groups of the position-limiting protrusions extends along the axial direction, and the position-limiting protrusions in each of the plurality of groups of the position-limiting protrusions are arranged at different positions.

5. The coil component according to claim 3, wherein the position-limiting protrusions of the plurality of groups of the position-limiting protrusions are arranged along a spirally shaped path with respect to an axis of the bobbin body.

* * * * *